US009475158B1

(12) United States Patent
McCarthy

(10) Patent No.: US 9,475,158 B1
(45) Date of Patent: Oct. 25, 2016

(54) METHOD FOR DISPLAYING AND SORTING GARMENTS

(71) Applicant: Gina McCarthy, San Jose, CA (US)

(72) Inventor: Gina McCarthy, San Jose, CA (US)

( * ) Notice: Subject to any disclaimer, the term of this patent is extended or adjusted under 35 U.S.C. 154(b) by 0 days.

(21) Appl. No.: 14/534,031

(22) Filed: Nov. 5, 2014

Related U.S. Application Data

(63) Continuation of application No. 13/418,353, filed on Mar. 13, 2012, now abandoned.

(51) Int. Cl.
*B23P 19/04* (2006.01)

(52) U.S. Cl.
CPC ..... *B23P 19/04* (2013.01)

(58) Field of Classification Search
CPC combination set(s) only.
See application file for complete search history.

(56) References Cited

U.S. PATENT DOCUMENTS 2,549,766 A * 4/1951 Benson ..... A47G 1/17 156/71
3,086,529 A * 4/1963 Munz ..... A61B 17/1322 128/878
3,540,060 A * 11/1970 Brown ..... A41B 13/103 2/49.2
4,310,832 A * 1/1982 Fitzgerald ..... G09F 13/10 340/815.47
5,611,192 A * 3/1997 Weder ..... B65B 25/026 53/219
7,303,711 B2 * 12/2007 Gallant et al. ..... B29C 43/222 264/220
2007/0029355 A1 * 2/2007 Dente, Jr. ..... A47B 61/003 223/85

* cited by examiner

*Primary Examiner* — Terrell Matthews

(57) ABSTRACT

A method for garment displaying and/or sorting is disclosed comprising, in one embodiment, affixing garments, such as socks, to a hook fastener. In one embodiment, a user may determine whether a select and/or matching pair of socks is affixed and, if a select and/or matching pair of socks is determined to be affixed, the user removes or pairs the select pair of socks or the socks determined to be matching. In another embodiment, a user may determine if a select or matching pair of socks is present among affixed socks and non affixed socks and pair that select or matching pair of socks. Hook fasteners may be affixed to or rested on a desired surface for displaying affixed socks or other garments.

16 Claims, 9 Drawing Sheets

METHOD FOR DISPLAYING AND SORTING GARMENTS

CROSS REFERENCE TO RELATED APPLICATIONS

This application is a continuation of U.S. patent application having Ser. No. 13/418,353 filed on Mar. 13, 2012 which claims the benefit of priority from provisional application having Ser. No. 61/465,271 filed on Mar. 16, 2011 which applications are hereby incorporated by reference.

BACKGROUND OF THE INVENTION

The problem of one of a pair of socks missing is a pervasive one. Typically, unmatched or unpaired socks are placed in a bin, drawer or the like and left, often times, forgotten. U.S. Pat. No. 5,667,081 describes a device for sorting and mating socks comprising a plurality of spaced apart openings formed to receive and retain a sock member or other garment to be paired.

An object of an embodiment of the present invention is to provide a new and improved method for sorting socks or other garments.

An object of an embodiment of the present invention is to provide a new and improved method for displaying socks and/or other garments.

An object of an embodiment of the present invention is to provide a new and improved method for increasing the likelihood of finding a matching and/or select pair of socks and/or other garments to be paired.

An object of an embodiment of the present invention is to provide a new and improved method for assisting with the pairing of socks and/other garments to be paired.

SUMMARY OF THE INVENTION

These and other objects have been met by, in one embodiment, a method comprising affixing garments (for example, socks or other garments to be paired such as for example, knit gloves or mittens) to a hook fastener (such as, for example, hook fasteners of the type known in prior art hook and loop fasteners). The method does not require the use of the loop portion/fastener of the hook and loop fastener to affix socks as it relies on qualities of the materials of which the socks themselves are comprised to affix the socks to the hook fastener. In another embodiment, the method further comprises viewing the affixed socks, determining whether a select and/or matching pair of socks or other garments is affixed and, if a select and/or matching pair of socks or other garments is determined to be affixed, removing or pairing the select pair of socks or other garments or the socks or other garments determined to be matching from the hook fastener. In another embodiment, the method further comprises viewing affixed socks and non affixed socks and determining whether a select and/or matching pair of socks or other garments is present among the affixed and non affixed socks. If so, the socks of the select and/or matching pair are typically removed from the other socks and/or paired together. Any or all of these steps may be repeated and may occur over any period of time.

Hooks of the hook fastener may be disposed on or integral with a fastener surface of the hook fastener such as a fastener sheet, fastener tape, fastener backing or other fastener surface. The fastener surfaces may be disposed on or affixed to a fastener support such as a fastener board or a plush animal, plush figure or the like.

The hook fastener may be affixed to or rested on a desired surface for display. Desired display surfaces include, but are not limited to, walls, tables, doors, floors, rugs, washing machines, dryers and cabinets and any other surface from which the socks or garments may be displayed when affixed to the hook fastener.

The hook fastener may be disposable or of a more permanent nature.

The hook fastener may be ornamental in shape and/or design.

By displaying socks or other garments to be matched or paired, the likelihood of finding a match between socks (or other garments) or a select pair of socks (or other garments) increases as compared to keeping unmatched socks (or other garments) hidden or out of sight in a bin or the like.

DETAILED DESCRIPTION OF THE INVENTION

Figure 1:
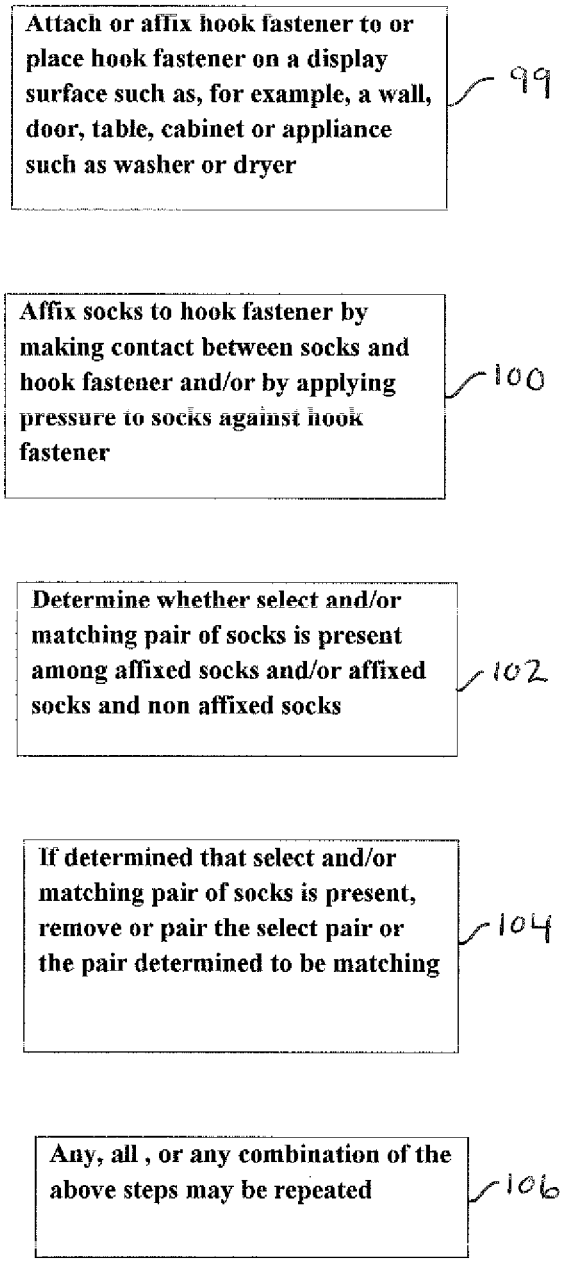
FIG. 1 is an embodiment of a method of the present invention.
Figure 2:
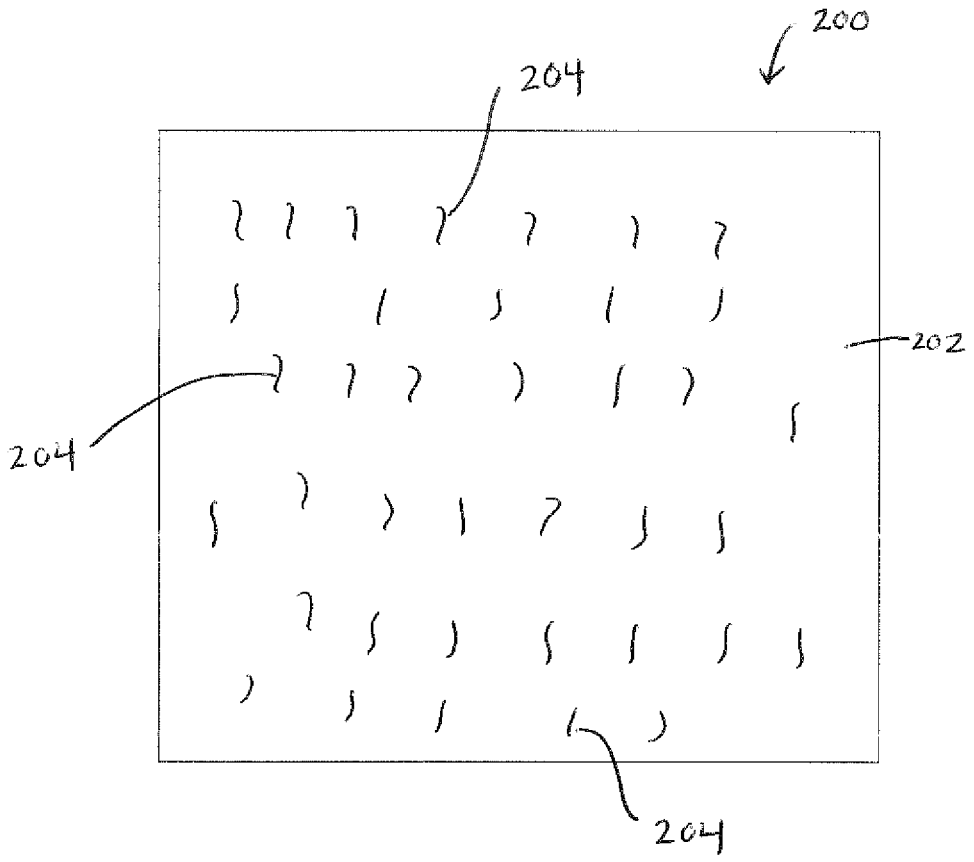
Fig. 2 Prior Art
FIG. 2 is a prior art hook fastener.
Figure 3A:
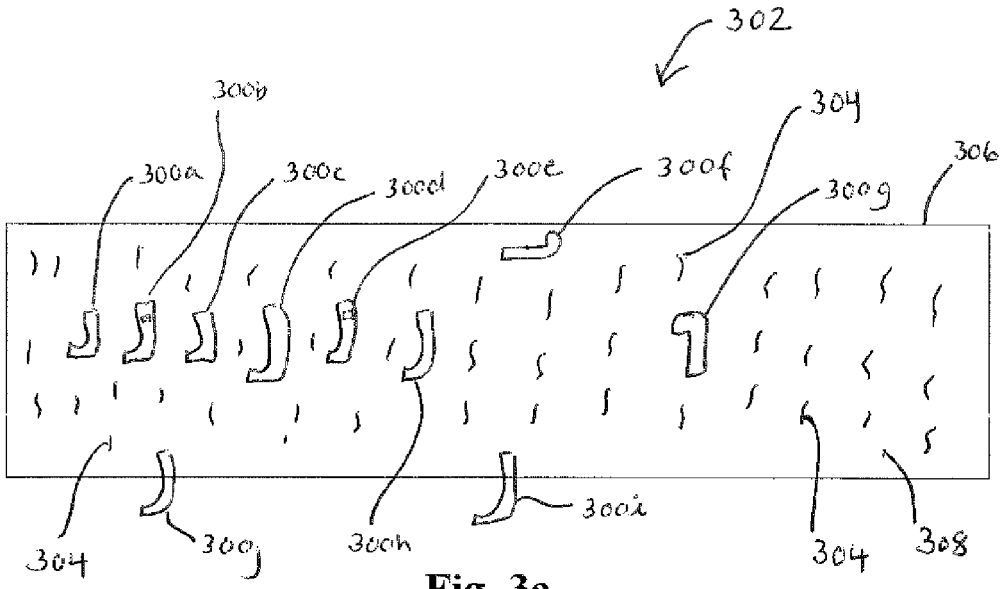
FIG. 3*a* is a front view of a hook fastener in an embodiment of the present invention.

With reference to FIGS. 1, 2 and 3*a*, an embodiment of a method for garment displaying and/or sorting is disclosed comprising affixing or adhering a hook fastener, such as for example hook fasteners in the prior art including hook fastener 200, or other hook fasteners or the like, to a display surface or placing a hook fastener on a display surface (step 99) and affixing garments to be paired, for example a plurality of socks 300, to the hook fastener 306, thereby forming a sock display 302 (step 100). The hook fastener 200 may have a fastener surface 202 and a plurality of hooks 204 represented in the figure as curved lines. The prior art hook fastener of FIG. 2, other hook fasteners and any hook fasteners described herein are examples of the hook fasteners that may be used in any or all embodiments of the present invention.

Referring to FIG. 3*a*, sock affixation may occur by applying pressure to at least a portion of one or more of the socks 300 to be sorted against the hook fastener. For example pressure may be applied against at least some of the hooks of the hook fastener (for example, hooks 304 (represented in the figure as curved lines) of hook fastener 306), such that at least a portion of each sock 300 becomes affixed to the hooks. In other words, sock affixation may occur by both contacting at least a portion of the sock against the hook fastener and applying pressure. In another example, sock affixation may occur merely by having at least a portion of one or more socks make contact with the hook fastener. For example, a sock may be dropped or tossed onto hooks 304 of fastener surface 308 or of any other hooks of any other fastener surface. Socks may be affixed to a hook fastener, such as hook fastener 306, one at a time or multiple socks at a time.

Referring back to FIG. 1, in one embodiment, the method of the present invention further comprises a user (the term "user" refers to one or more people) viewing the affixed socks and determining whether a matching pair of socks (or some other select coupling or grouping of socks or garments that a user desires to pair, match or group) is affixed (step 102) and/or is present among affixed socks and non affixed socks. The non affixed socks may be, for example, socks from a drawer, bin or dryer. Referring to FIGS. 1 and 3, in one embodiment, the method of the present invention further comprises that if the user determines that a matching pair of socks (or some other select coupling or grouping of socks that the user desires to pair, match or group) is affixed, for example 300*b* and 300*e* of FIG. 3*a*, or is present among affixed socks and non affixed socks, the user may remove and/or pair the matching pair or select pair or group (step 104) and leave the remaining socks 300*a*, 300*c-d*, and 300*f-j* on display to be viewed at a later time so that a later determination may be made with regard to the remaining socks whether a matching or select pair of socks is affixed or is present among the affixed socks and non affixed socks.

The user may or may or may not continue with step 102 of determination of whether a matching pair of socks or a select pair of socks is present and/or step 104 removing and/or pairing the select pair of socks or the pair of socks determined to be matching after step 100. Any, all, or any combination of these steps may be repeated (step 106).

These steps may occur over any period of time and the period between each step may comprise any period of time. A user may first affix a single sock or a plurality of socks to the hook fastener within any desired period of time, and later affix a second, and/or additional socks, within any desired period of time (for example, minutes, hours, days, weeks or months later). A user may look for sock matches or select pairs or groups of socks after the socks are affixed, for example, immediately after affixation or minutes, hours, days, weeks or even months later. Socks are left on display for any desired amount of time.

Referring to FIG. 3*a*, the socks, for example socks 300*a*-300*j*, may be of any size including infant, children and adult socks. In one embodiment infant, children, and adult socks are affixed on separate hook fasteners. The socks may be affixed in any state including, for example, inside out or right-side in. The socks may be affixed in any direction including, for example, upside down (for example, sock 300*g*), right-side up (for example, socks 300*a-e*, 300*i-j*), diagonally (for example, sock 300*h*) or horizontally (for example, sock 300*f*). In one example, not depicted, socks are all attached in the same direction so as to, in some instances facilitate matching. The socks may be affixed on any portion of the fastener such as for example, on the middle 309, top 310, bottom 312 or side 314. The socks may be affixed in entirety (for example socks 300*a-h*) or just a portion of the sock may be affixed (for example socks 300*i-j*).

Referring to FIG. 2, the hook fastener 200 comprises a hook fastener known in prior art hook fasteners of prior art hook and loop fastening systems. The hook fastener 200 comprises, for example, a fastener surface 202 and hooks 204 of the type of fastener surfaces and hooks known in prior art hook fasteners of prior art hook and loop fastening systems. For example, such hook and loop systems are sold under the trademarks VELCRO, DURAGRIP, SCOTCH FASTENERS, and EASY TAPE. Hook and loop systems are also known as burr or touch fasteners. The hooks may be of various shapes including for example, mushroom shapes. For example, the hook fasteners are of the type found in hook and loop systems on fastening tabs on disposable diapers such as, for example, HUGGIES brand. In another example the hooks may be of the type found in hook and loop systems found on running shoes. In one example VELCRO STICKY BACK general purpose hook fasteners may be used. In another example, SCOTCH FASTENERS (reclosable) may be used. In one embodiment the hooks may be, for example, woven and, in another embodiment, the hooks may be, for example, molded.

The hook fasteners used with the method and apparatuses of the present invention may be comprised of a desired sock binding ability. For example, certain hooks of hook fasteners strongly affix socks to the hooks while other hooks may affix socks less strongly to the hooks. It may be desired to use hooks that affix socks less strongly than other hooks. For example, this may be desirable when sorting thin socks or socks that the user does not wish to form a relatively strong attachment with the hooks. The hooks may be of the same or various sizes and shapes and may be large enough to see with the naked eye or too small to see without magnification.

Figure 4:
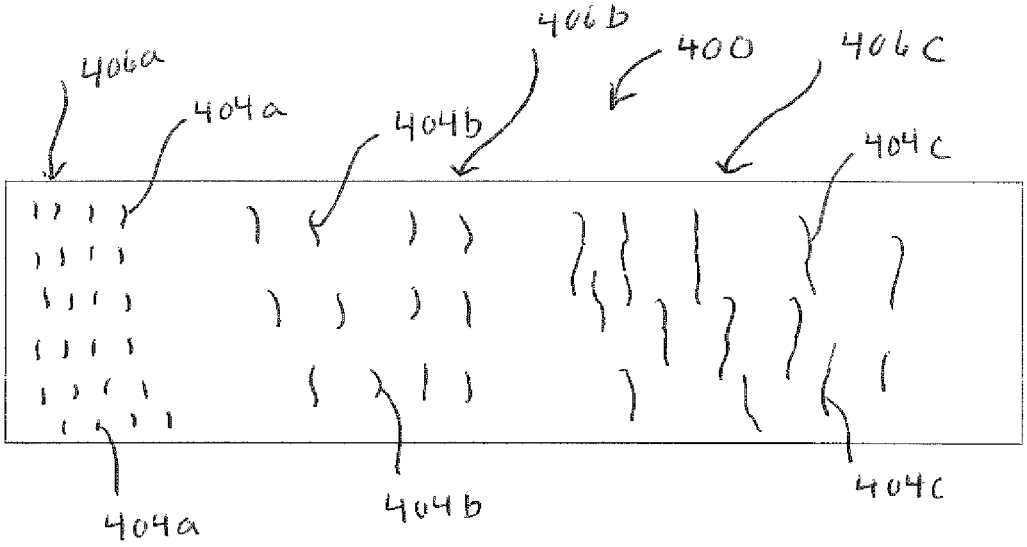
FIG. 4 is a front view of a hook fastener of an embodiment of the present invention.

With reference to FIG. 4, a hook fastener 400 having a fastener surface 402 may include areas such as 406*a*, 406*b*, 406*c* having different garment bonding capabilities. For example, areas 406*a*, 406*b*, 406*c* may have groups of hooks, for example 404*a*, 404*b*, 404*c*, respectively, decreasing in garment bonding capabilities when proceeding left to right. Alternatively, separate hook fasteners may each have different garment bonding capabilities.

Fastener surfaces for sock affixation may alternatively include fasteners other than hooks that bind to socks and from which socks may be removed, such as pressure sensitive adhesives.

Hook fasteners of embodiments of the present invention, for example hook fasteners 306 (FIG. 3), 500 (FIG. 5), 600 (FIG. 6), 700 (FIG. 7) and 800 (FIG. 8) may include hooks 304, 502, 602, 702, 802 (all represented by curved lines) disposed on or integral to fastener surfaces, for example, fastener sheet 308, fastener tape 504, fastener backing 604, fastener backing 704, fastener backing 804, respectively, or other desired surface. The fastener sheet, fastener tape (typically narrower than a fastener sheet), fastener backing or other fastener surface may be of any desired size and shape but are preferably large enough to accommodate a plurality of, and typically several, socks. In one example, a hook fastener having a fastener backing, for example hook fastener 600, 700 or 800, is affixed to or disposed on a fastener support, for example a fastener board such as fastener board 604, 705, or 805, respectively, to display socks 300.

Figure 3B:
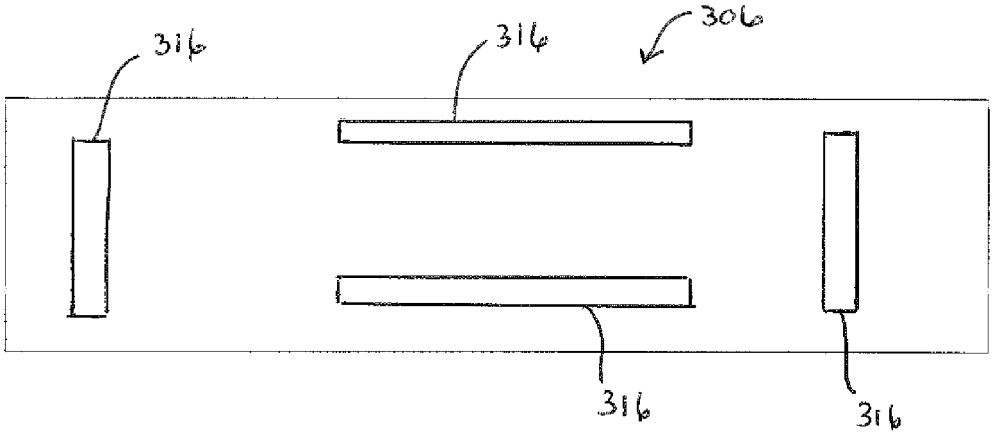
FIG. 3*b* is a back view of the hook fastener of FIG. 3*a*.

In one example, the hook fastener may be affixed to a display surface by, for example, connecting, attaching, or mounting to a display surface using mechanisms known in the art before or after affixing socks to hook fasteners. In one embodiment, the hook fastener includes adhesive on a back surface that adhere the hook fastener to a display surface. With reference to FIGS. 3*a*, 3*b*, adhesive strips 316 may be disposed on one or more locations on a back of the fastener surface, for example fastener sheet 308. Hook fastener 300 may be attached to a display surface, for example wall 318, with, for example, adhesive strips 316.

Figure 5A:
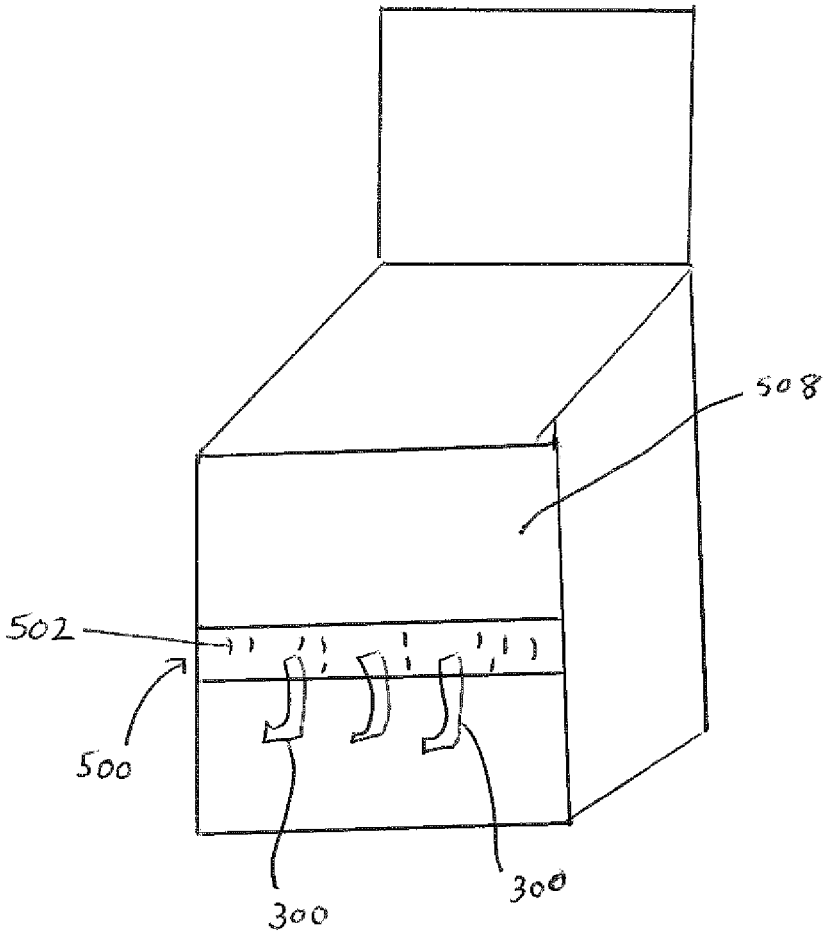
FIG. 5*a* is a front view of a hook fastener in an embodiment of the present invention.
Figure 5B:
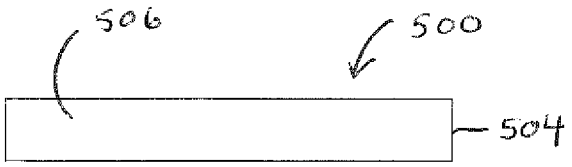
FIG. 5*b* is a back view of the hook fastener of FIG. 5*a*.

Referring to FIGS. 5*a*, 5*b*, in another embodiment, adhesive (not shown) may be disposed all about the back 506 of a fastener surface, as shown with, for example, fastener tape 500. Fastener tape 500 may be attached to a display surface, for example washing machine face 508 with the adhesive.

Figure 6:
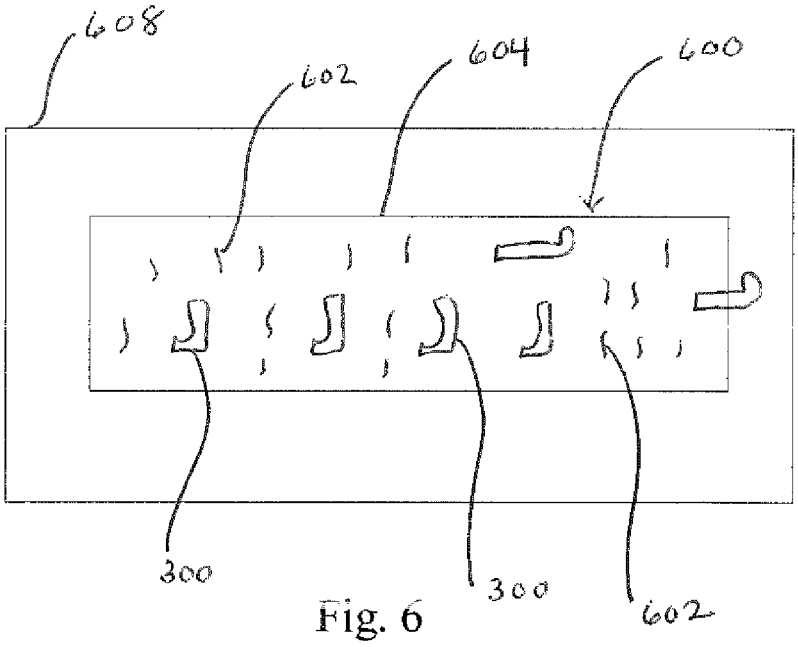
FIG. 6 is a top view of a hook fastener in an embodiment of the present invention.

In another example, the hook fastener may be placed to rest on a display surface. For example, as seen in FIG. 6, fastener hook 600 rests on table 608.

Figure 7A:
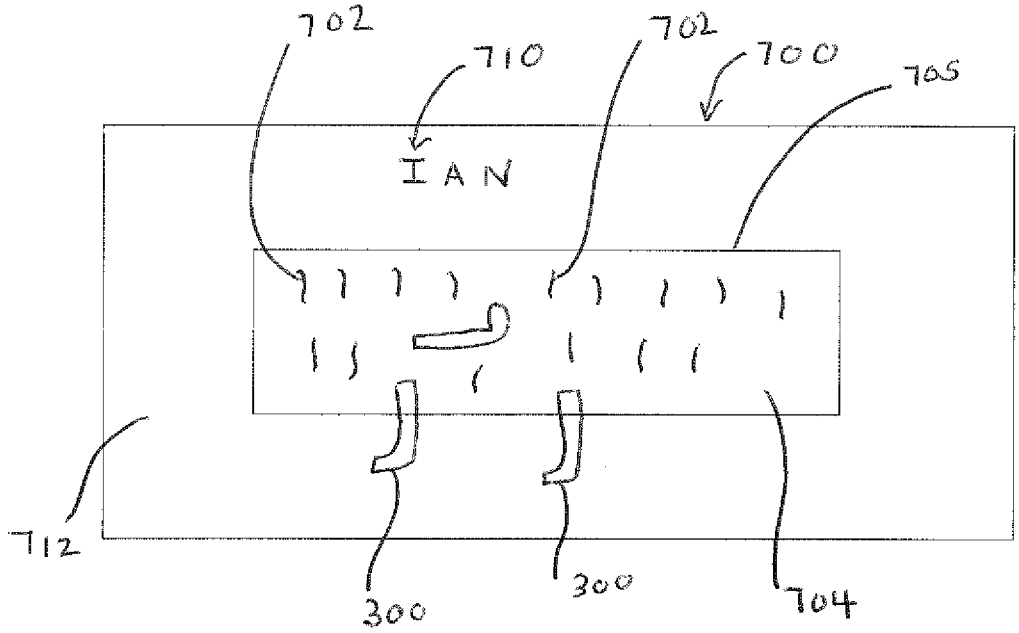
FIG. 7*a* is a front view of a hook fastener in an embodiment of the present invention.
Figure 7B:
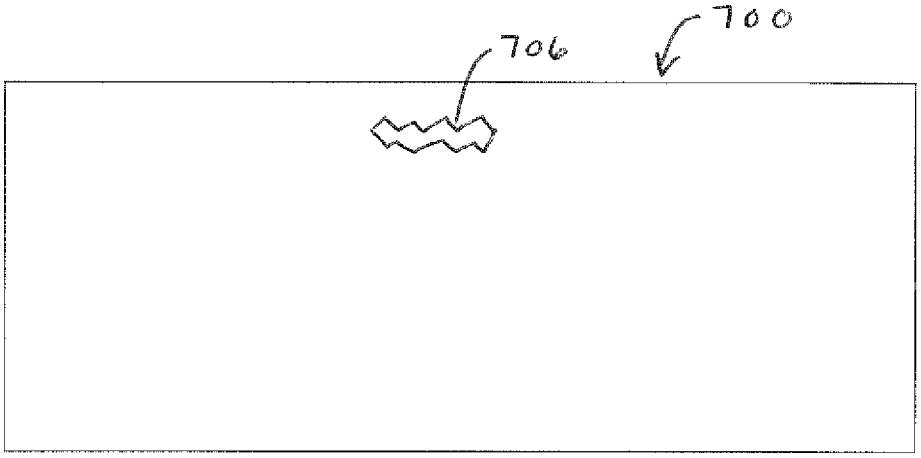
FIG. 7*b* is a back view of the hook fastener FIG. 7*a*.

In one embodiment, the hook fastener includes a nail hanger that attaches the hook fastener to a display surface. Referring to FIGS. 7*a*, 7*b*, in one example, the hook fastener 700 includes a nail hanger 706 that attaches the fastener board 704 to a display surface, for example wall 708, using a nail (not shown).

In another embodiment, the hook fastener utilizes a hook and loop system known in the art for attachment of the hook fastener to a display surface. Referring to 8*a*, 8*b*, in one example, hook fastener 800 uses hook and loop system including hook fastener 808 and loop fastener 810, for attaching the hook fastener 800 to the display surface. Loop fastener 810 on the rear of board 804 is affixed to hook fastener 808 affixed, and typically adhered, to wall 812 (or vice-versa).

Examples of display surfaces include, but are not limited to, a floor, rug, table, a wall such as a laundry room wall, a nursery room wall or a bedroom wall, an inside or outside door surface (including, for example, a closet or cabinet door), and/or washing machine or dryer surface.

In one embodiment, the hook fastener may be disposable. Referring to FIGS. 3 and 5, in one example, hooks 304 and 502 may be disposed on or integral with a fastener sheet 308 and/or disposable fastener tape 504 of hook fasteners 306 and 500, respectively, that are disposable and that have adhesive or other affixation means on the back. As the ability of the sheet or tape to affix socks lessens, the sheet may be removed from the display surface and any affixed socks removed and affixed to a replacement hook fastener.

Figure 9:
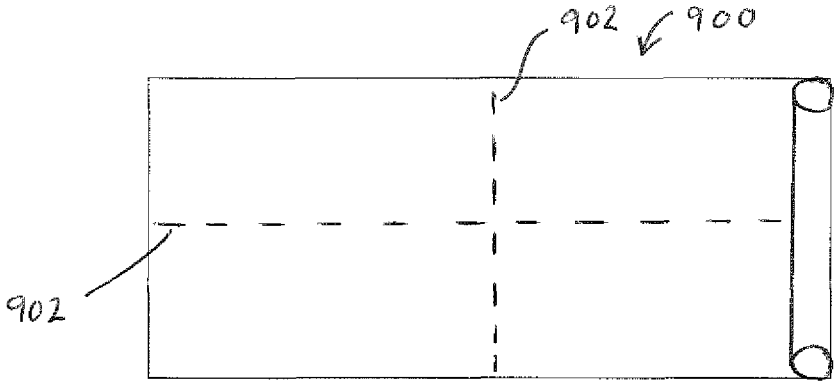
FIG. 9 is a top view of a hook fastener in an embodiment of the present invention.
Figure 11:
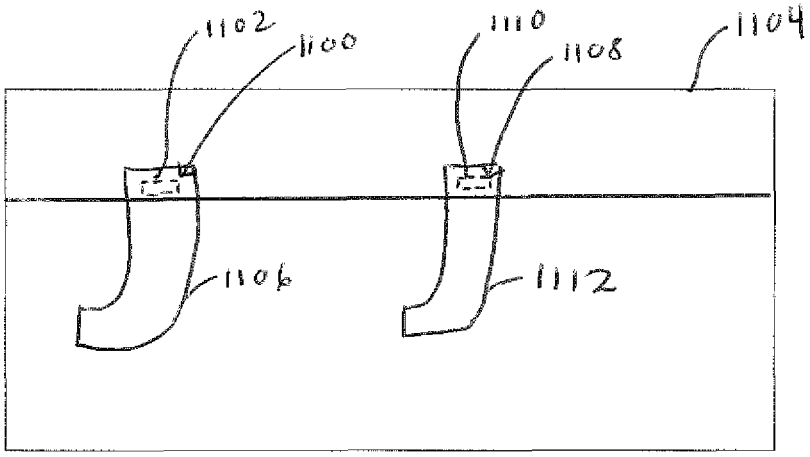
FIG. 11 is a front view of hook fasteners in an embodiment of the present invention.

Referring to FIG. 9, in one embodiment, the disposable fastener sheet or the disposable fastener tape having hooks may comprise a roll 900 and may include perforations 902 (vertical, horizontal, or along other directions) so that a desired size and/or shape of sheet or tape may be selected. For example, fastener sheet or fastener tape may be the length of a display surface, such as a wall, or any desired portion of a display surface.

In another embodiment, the hook fastener, for example, a disposable hook fastener including a fastener surface with hooks that is disposed on a fastener support. For example, hook fastener 700 may include a fastener sheet 308 with hooks 304 or fastener tape 500 with hooks 502 that may be attached to the fastener board (for example a planar, front surface of the fastener board) by, for example an adhesive 316 or 506. The fastener sheet 308 or fastener tape 500 may be peeled off or otherwise removed from the fastener board and replaced with another fastener sheet or tape.

In one embodiment, the hook fastener, for example hook fasteners 600, 700 or 800, may be longer lasting or largely permanent. For example, the fastener surfaces of hook fasteners 600, 700, or 800 (fastening boards 604, 704, 804) may include hook fasteners of the VELCRO type found on, for example running shoes, which may be of a longer lasting variety or largely permanent.

Figure 8A:
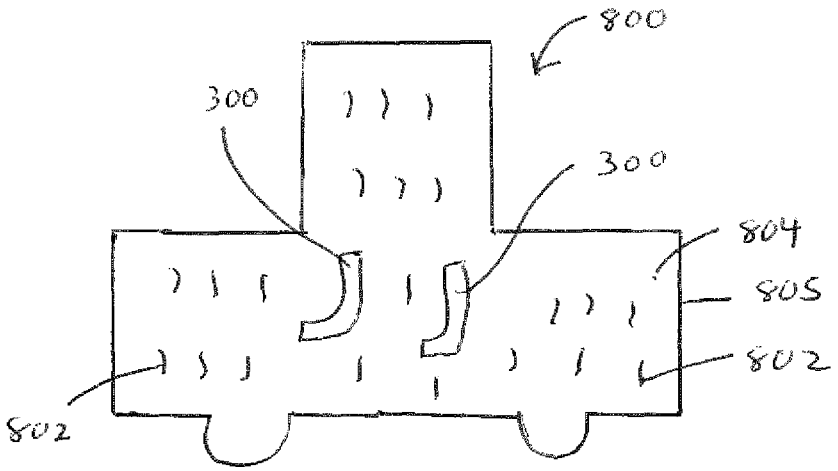
FIG. 8*a* is a front view of a hook fastener of an embodiment of the present invention.
Figure 8B:
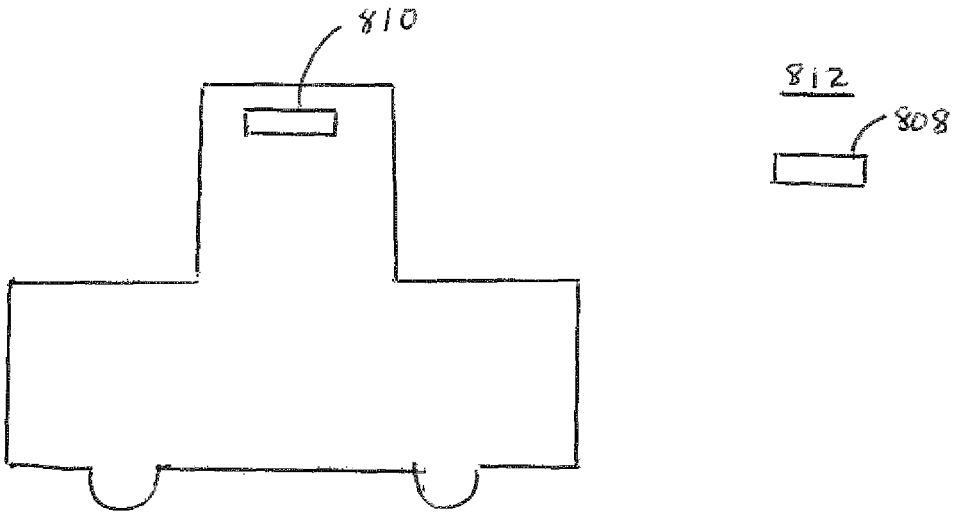
FIG. 8*b* is a back view of the hook fastener of FIG. 8*a*.

As seen in FIGS. 7 and 8, the hook fasteners 700, 800 are ornamental in shape and/or design. Other hook fasteners having different fastener surfaces may also be ornamental in shape and/or design. In FIG. 7, hook fastener 700 includes a user's name 710 and a frame portion 712. The hook fasteners may include other ornamental shapes and designs. The hooks and/or the fastener surfaces, for instance hooks 702 and 802 and fastener backings 704 and 804, may be of different colors that would assist in different socks standing out from the hooks and fastener surfaces. In FIG. 8, fastener backing 804 and fastener board 895 are shaped like a car.

Figure 10A:
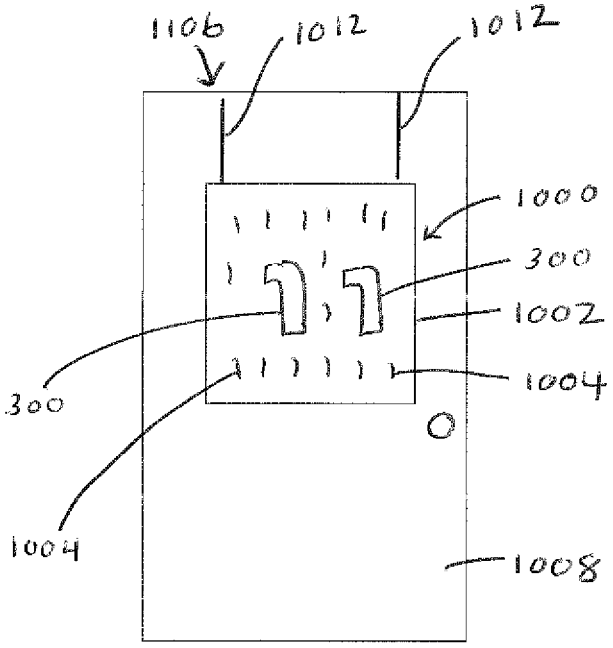
FIG. 10*a* is a front view of a hook fastener in an embodiment of the present invention.
Figure 10B:
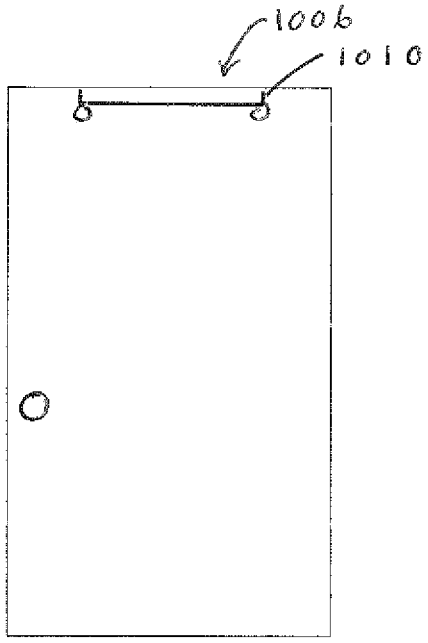
FIG. 10*b* is a back view of hook fastener hanger of FIG. 10*a*.

Referring to FIGS. 10*a*, 10*b*, in another embodiment of the present invention, a hook fastener, such as hook fastener 1000 including a fastener board 1002 with hooks 1004 (represented by curved lines) disposed thereon may be attached to an over-the-door hanger 1006 so that it may displayed within or outside of a door, such as closet door 1008. The over the door hanger 1006 includes a hanger portion 1010 attached or connected to hook fastener 1000 via connecting rods 1012. As discussed above, a fastener surface, such as a fastener sheet or fastener tape, on or with which the hooks are integral, may be affixed to the fastener board.

In another embodiment, the hook fastener is used to display one sock when the one sock is affixed to the hook fastener and the hook fastener surface is affixed to a display surface.

In another embodiment, separate hooks fasteners are affixed to one or more display surfaces in close proximity to one another and one or more socks is affixed to each of the separate hook fasteners. The separate fastener surfaces of the hook fasteners may be adjacent to one another. For example, a hook fastener 1100 having a hook fastener strip 1102 is affixed (for example, adhered) to a mantle 1104 and used to display a stocking 1106 next to another hook fastener 1108 having a hook fastener strip 1110 used to display another stocking 1112. In another example, a hook fastener displaying one or more socks is affixed to one display surface, for example a wall, and another hook fastener hook displaying one or more socks is affixed to another display surface, for example a cabinet door disposed above the wall.

Though the methods and apparatuses described above may refer to use with one sock or a plurality of socks, the methods or apparatuses may be used with any garment or garments that affix to hook fasteners or that affix to other fasteners.

The invention claimed is:

1. A method for displaying socks, comprising:

(a) removably adhering a hook fastener to a display surface, wherein said hook fastener is of the type found in a hook and loop fastener, comprises a sheet of a desired size or shape and is disposable;

(b) affixing socks to the hook fastener by making contact between said socks and said hook fastener, wherein said display surface is a room wall or a door.

2. The method of claim 1 wherein said hook fastener includes a fastener surface that has adhesive on a back surface.

3. The method of claim 1 wherein said hook fastener is of the type found in disposable diapers.

4. The method of claim 1 further comprising providing a roll having perforated sheets of hook fastener, obtaining a sheet of hook fastener from the roll by tearing the sheet of hook fastener from the roll at perforations, wherein the sheet of hook fastener is removably adherable to the display surface.

5. The method of claim 4 wherein obtaining the sheet of hook fastener from the roll includes obtaining a selectable size or shape of the sheet of hook fastener.

6. The method of claim 4 wherein said perforated sheets of hook fastener include a fastener surface that has adhesive on a back surface.

7. The method of claim 1 wherein the hook fastener is obtained from a roll of hook fastener sheets connected by perforations.

8. The method of claim 1 wherein the hook and loop fastener is VELCRO.

9. A method for displaying socks, comprising:

(a) removably adhering a hook fastener to a room wall or door, wherein said hook fastener is of the type found in a hook and loop fastener, comprises a sheet of a desired size and is disposable;

(b) attaching socks to said hook fastener, thereby creating a sock display.

10. The method of claim 9 further comprising providing a roll having perforated sheets of hook fastener, obtaining a sheet of hook fastener from the roll by tearing the sheet of hook fastener from the roll at perforations, wherein the sheet of hook fastener is removably adherable to the display surface.

11. The method of claim 10 wherein obtaining a sheet of hook fastener from the roll includes obtaining a selectable size or shape of the sheet of hook fastener.

12. The method of claim 10 wherein said perforated sheets of hook fastener include a fastener surface having adhesive on a back surface.

13. The method of claim 9 wherein the hook and loop fastener is VELCRO.

14. The method of claim 9 wherein a material of which the sock is comprised is attachable to the hook fastener.

15. The method of claim 9 wherein the hook fastener is obtained from a roll of hook fastener sheets connected by perforations.

16. The method of claim 1 further comprising removing the hook fastener from the display surface.

* * * * *